US006286937B1

(12) United States Patent
Uno

(10) Patent No.: US 6,286,937 B1
(45) Date of Patent: Sep. 11, 2001

(54) DIRECT PRINTING APPARATUS WITH FIRST AND SECOND ROLLERS

(75) Inventor: Koji Uno, Kobe (JP)

(73) Assignees: Minolta Co., Ltd., Osaka (JP); Array Printers AB, Västra Frölunda (SE)

( * ) Notice: Subject to any disclaimer, the term of this patent is extended or adjusted under 35 U.S.C. 154(b) by 0 days.

(21) Appl. No.: 09/348,800

(22) Filed: Jul. 7, 1999

(30) Foreign Application Priority Data

Jul. 9, 1998 (JP) ..... 10-194160

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS

| | | | | |
|---|---|---|---|---|
| 4,814,796 | | 3/1989 | Schmidlin | 346/155 |
| 5,477,250 | | 12/1995 | Larson | 347/55 |
| 5,988,794 | * | 11/1999 | Tagaki | 345/55 |
| 6,151,475 | * | 11/2000 | Uno | 347/55 |

* cited by examiner

*Primary Examiner*—Raquel Yvette Gordon
(74) *Attorney, Agent, or Firm*—Morrison & Foerster LLP

(57) ABSTRACT

The present invention provides a direct printing apparatus in which a good image is printed without background fog even if toner charge quantity is large. The direct printing apparatus is composed of a printing particles bearing member comprising a first roller 5 and a second roller 6, a backing electrode 13 and a printing head 15. The voltage applied to control electrodes 17 disposed around a plurality of holes 16 of the printing head 15 is controlled, whereby the printing particles 8 borne on the printing particles bearing member 5, 6 pass through the holes 16 of the printing head 15 to print the image on a print medium 2. A voltage having same polarity as the printing particles 8 borne on the bearing means 5, 6 and having electric potential more than that of surface layer of the printing particles 8 is applied to the control electrodes 17 corresponding to non-printing portions. The voltage Vw applied to the control electrodes 17 corresponding to non-printing portions meets the following relationship:

$$|Vw-V2| \geqq |V1-V2|$$

where V1 is a voltage of the first roller 5, and V2 is a voltage of the second roller 6.

2 Claims, 4 Drawing Sheets

DIRECT PRINTING APPARATUS WITH FIRST AND SECOND ROLLERS

This application is based on application No. H10-194160 filed in Japan on Jul. 9, 1998, the content of which is hereby incorporated by reference.

FIELD OF THE INVENTION

The present invention relates to a direct printing apparatus for use in copying machine, printer and so on.

BACKGROUND OF THE INVENTION

Hitherto, as a kind of direct printing apparatus for directly forming an image on a sheet, an apparatus which forms the image by using printing particles such as toner has been known. The direct printing apparatus comprises a developing device for bearing toner to serve development, the developing device having double rollers comprising a first roller and a second roller, a backing electrode opposed to the second roller of the developing device, and a printing head disposed between the backing electrode and the second roller, the printing head having a plurality of apertures and control electrode surrounding the plurality of apertures. To the first roller of the developing device is applied a voltage V1, while to the second roller is applied a voltage V2. To the backing electrode is applied a voltage $V_{BE}$, thereby an electric field is generated between the second roller and the backing electrode for propelling the toner toward the backing electrode side from the second roller through the apertures. To the control electrode of the printing head is selectively applied either a printing voltage Vb having a reverse polarity to the toner or a non-printing voltage Vw having a same polarity as the toner.

FIG. 4(A) shows an electric potential distribution between the first roller, the second roller and the control electrode of the conventional direct printing apparatus. When applying the voltage Vb (for example, +300 volts) having a reverse polarity to the toner to the control electrodes, the toner on the second roller to which a voltage of, for example, V2=0 is applied (i.e., connected to the earth) is propelled. On the other hand, when applying the voltage Vw (for example, −50 volts) having a same polarity as the toner to the control electrodes, the toner is never propelled. Thus, when the applying voltage Vb, Vw to the control electrodes of the printing head are changed on the basis of a desired image signal, a toner image corresponding to the image signal is formed in the sheet.

If the toner charged quantity is large, the adhesive strength to the second roller becomes large. Therefore, the toner is difficult to be propelled, thereby desired image density is not obtained. So, in the case that the toner charged quantity is large, the following provision has been made. As shown in FIG. 4(B), the applied voltage V1 to the first roller is enlarged in comparison to the case that toner charged quantity is small. Thereby, movement of the toner to the second roller from the first roller is accelerated so that adhered toner on the second roller becomes large in quantity, i.e., becomes multilayered. Thus, the adhesive strength of the surface layer toner to the second roller becomes small so that the toner is easy to be propelled, thereby desired image density is obtained.

However, the surface layer of the multilayered toner on the second roller, as shown in FIG. 4(B), is elevated to the same electric potential (−200 volts) as that of the first roller. Thus, even at the non-printing portion, a few of the toner on the second roller is propelled, causing fog in the background of the image.

SUMMARY OF THE INVENTION

Accordingly, the present invention has been accomplished to solve the aforementioned disadvantages of the prior arts. An object of the present invention is to provide a direct printing apparatus which is possible to form good image without background fog even if toner charged quantity is large.

In order to achieve the aforementioned object, according to the present invention, there is provided a direct printing apparatus for directly depositing printing particles on a print medium to print an image, comprising:

a bearing member for bearing printing particles thereon, the printing particles being charged to a predetermined polarity;

a backing electrode opposed to the bearing member; and a printing head disposed between the bearing member and the backing electrode, the printing head having a plurality of apertures through which the printing particles can propel and a plurality of control electrodes disposed around the plurality of apertures;

wherein the bearing member comprises a first roller and a second roller which comes into contact with the first roller and is opposed to the backing electrode; and wherein a voltage having same polarity as the printing particles borne on the bearing means and having electric potential more than that of surface layer of the printing particles is applied to the control electrodes corresponding to non-printing portions.

Preferably, the voltage Vw applied to the control electrodes corresponding to non-printing portions meets the following relationship:

$$|Vw-V2| \geqq |V1-V2|$$

where V1 is a voltage of the first roller, and V2 is a voltage of the second roller.

In the direct printing apparatus according to the present invention having above construction, as a voltage having same polarity as the printing particles borne on the bearing means and having electric potential more than that of surface layer of the printing particles is applied to the control electrodes corresponding to non-printing portions, an electric field having a direction to which the printing particles are not propelled to the control electrodes is generated, enabling to form good image without background fog even if toner charged quantity is large.

BRIEF DESCRIPTION OF THE DRAWINGS

Further objects and advantages of the present invention will be become clear from the following description taken in conjunction with the preferred embodiments thereof with reference to the accompanying drawings, in which.

DETAILED DESCRIPTION OF THE PREFERRED EMBODIMENTS

Figure 1:
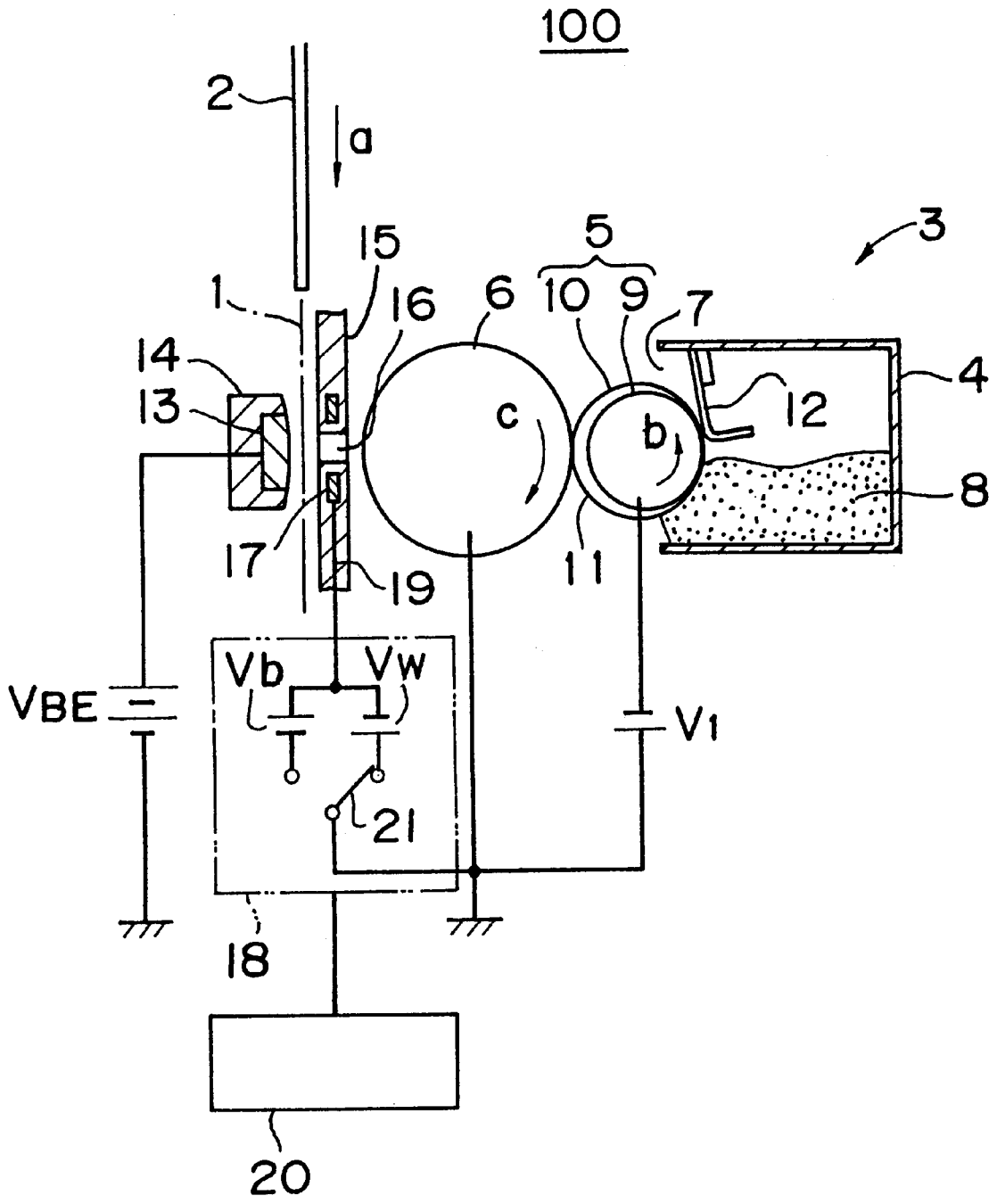
FIG. 1 is a schematic cross-sectional view of a direct printing apparatus according to the present invention.

With reference to FIG. 1, there is shown a direct printing apparatus 100 according to an embodiment of the present invention.

The printing apparatus 100 is arranged to print an image on a sheet 2 conveyed along the sheet passage 1 in a direction indicated by an arrow "a" from a sheet feed roller (not shown) . The printing apparatus 100 is provided with a developing apparatus generally indicated by reference numeral 3. The developing apparatus 3 comprises a container 4, a first roller 5 and a second roller 6. The container 4 has an opening 7 and accommodates printing particles, i.e., toner particles (hereinafter simply referred to as toner) 8 which comprise one component and capable of being charged with negative polarity. The first roller 5 is disposed in the opening 7 of the container 4 and comprises a drive roller 9 rotatably supported in a direction of arrow "b" and a developing sleeve 10 inserted outside the drive roller 9.

The developing sleeve 10 is made of metal material such as nickel or resin material such as carbon-contained nylon. The inner diameter of the developing sleeve 10 is larger than the outer diameter of the drive roller 9. The developing sleeve 10 is formed with a slack 11 by coming into contact with the drive roller 9. The developing sleeve 10 is capable of rotating along with the drive roller 9 in a direction of arrow "b". A blade 12, preferably made of metal material such as stainless steel, extends from the wall of the container 4 and comes into contact with the outer surface of the developing sleeve 10. To the developing sleeve 10 is applied a voltage V1. The second roller 6 is disposed so that it comes into contact with the slack 11 of the developing sleeve 10 of the first roller 5 and is opposed to a backing electrode 13 as described hereinafter. The second roller 6 is rotatably supported in a direction of arrow "c". The second roller 6 is made of conductive material and is electrically connected to the earth (V2=0 bolt).

The printing apparatus 100 is also provided with a backing electrode generally indicated by reference numeral 13. The backing electrode 13 is disposed at the opposite side to the developing apparatus 3 with respect to the sheet passage 1 so that the backing electrode 13 is opposed to the second roller 6. The backing electrode 13 is held by the support 14 made of insulating material. To the backing electrode 13 is applied a voltage $V_{BE}$ of predetermined polarity (positive polarity in this embodiment), for example, +1200 volts. Thus, between the backing electrode 13 and the second roller 6 is formed an electric field that the negatively charged toner 8 on the second roller 6 is electrically attracted to the backing electrode 13.

Between the developing apparatus 3 and the backing electrode 13 and at the opposite side to the backing electrode 13 with respect to the sheet passage 1, the printing apparatus 100 is also provided with a printing head generally indicated by reference numeral 15. At a region where the second roller 6 and the backing electrode 13 are opposed to each other, the printing head 15 is formed with a plurality of apertures 16 having a diameter of about 25 to 200 micrometers which is substantially larger than an average diameter (about several micrometers to a dozen micrometers) of the toner 8. The apertures 16 are disposed in a direction perpendicular to the sheet passage 1.

The printing head 15 further includes therein doughnut-like control electrodes 17 which surround the respective apertures 16. The control electrodes 17 are electrically connected to a driver 18 through a printed wire 19 so that the driver 18 can transmit image signals to the control electrodes 17, respectively. The driver 18 is in turn electrically connected to a controller 20 that feeds out data of image.

The image signals to be transmitted to the control electrodes 17 consist of a voltage Vw applied to the control electrodes 17 around the apertures 16 corresponding to non-print portions of the sheet 2 and a voltage Vb applied to the control electrodes 17 around the apertures 16 corresponding to print portions of the sheet 2. The voltage Vw and Vb are switched by a switch 21 in response to the image data from the controller 20. In this embodiment, for example, in the case that the toner charged quantity is small, the voltage Vw for the non-print portion W is about −50 volts, and voltage Vb for the print portion B is about +300 volts. In the case that the toner charged quantity is large, the voltage Vw for the non-print portion W is about −200 volts, and voltage Vb for the print portion B is about +300 volts.

In summary, the voltages V1, V2, Vw and Vb applied to the developing sleeve 10 of the first roller 5, the second roller 6 and the control electrodes 17 respectively are as in Table 1.

TABLE 1

| Toner Charged Quantity | Electric Potential (volt) | | | |
|---|---|---|---|---|
| (μc/q) | Vb | Vw | V2 | V1 |
| −5 | +300 | − 50 | 0 | 0 |
| −15 | +300 | −200 | 0 | −200 |

Operation of the direct printing apparatus 100 having above construction will now be described.

In the printing apparatus 100, a main motor (not shown) is driven to rotate the drive roller 9 of the first roller 5, which is applied with zero voltage, in the direction of arrow "b", whereby the developing sleeve 10 rotates in the same direction. The toner 8 in the container 4 is moved on the developing sleeve 10 and then transported to a contact region with the blade 12 where the toner 12 is provided with triboelectric negative charge by the frictional contact with the blade 12. Thereby, the toner 8 is carried on the developing sleeve 10. The toner 8 carried on the developing sleeve 10 is delivered to the second roller 6 at an opposite portion to the second roller 6 connected to the earth.

In the printing head 50, the voltage Vw of about −50 volts is applied to the control electrodes 17 at the non-printing time. Therefore, the negatively charged toner 8 on the second roller 6 electrically repels against the control electrodes 17 and therefore stays on the second roller 6 without propelling toward the aperture 16.

Figure 2:
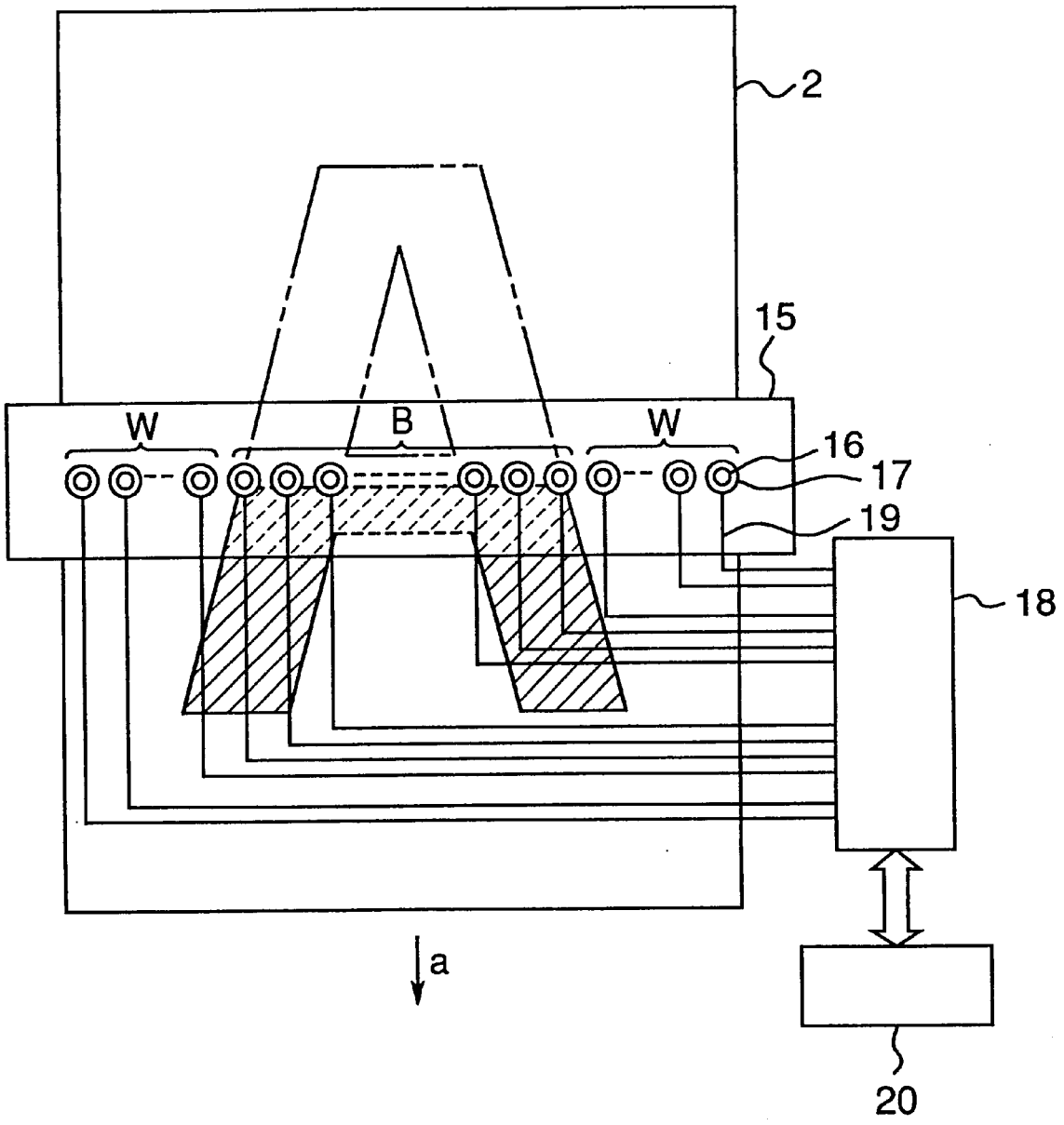
FIG. 2 is a front view of the printing head in FIG. 1.

The controller 20 outputs the image data corresponding to an image to be reproduced to the drivers 18. In response to the image data, the driver 18 applies the voltage Vw of −50 volts to the non-print portion W and the voltage Vb of +300 volts to the print portion B by switching the switch 21. For example, as shown in FIG. 2, in the case that the character image "A" is to be printed, the driver 18 applies the voltage Vw of −50 volts to the control electrode 17 around the aperture 16 corresponding to the non-print portions W and the voltage Vb of +300 volts to the control electrode 17 around the aperture 16 corresponding to the print portions B.

Figure 3A:
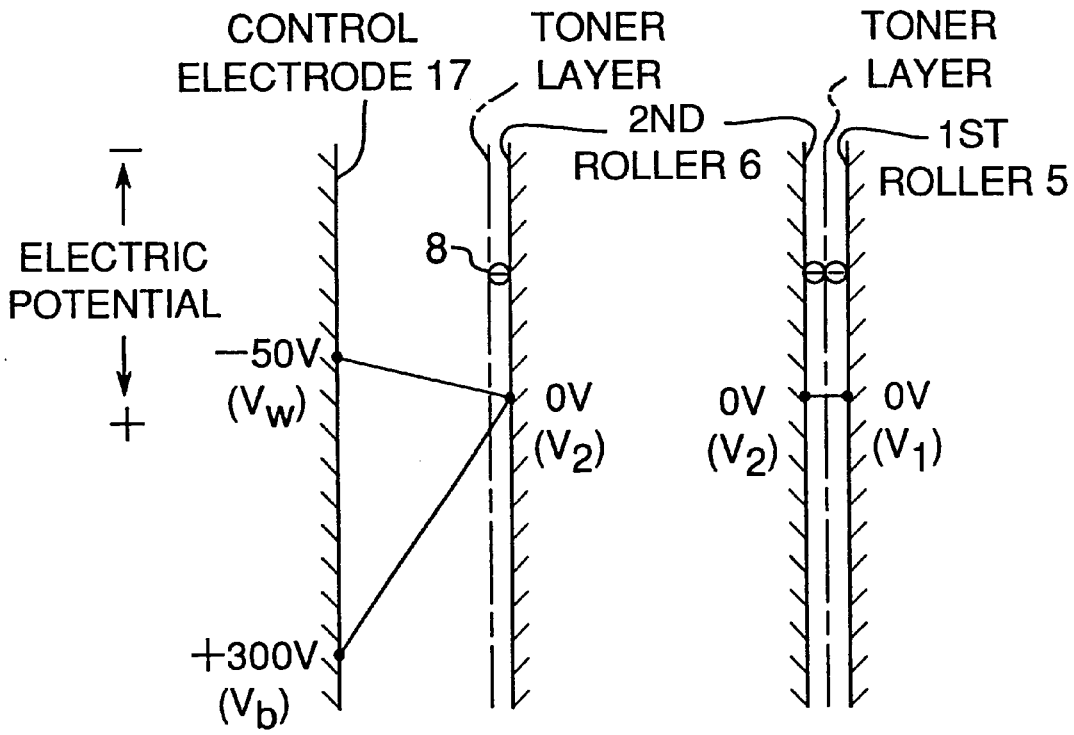
FIG. 3 is a chart showing an electric potential distribution between the first roller, the second roller and the control electrode of the direct printing apparatus according to the present invention in the case that toner charged quantity is small (A) and in the case that toner charged quantity is large (B)

As a result, at the non-print portion W, as shown in FIG. 3(A), the control electrodes 17 have same polarity as the toner 8 on the second roller 6 and have an electric potential existing on the minus side with respect to the second roller 6. Thus, the toner 8 on the second roller 6 is not propelled to the control electrodes 17, whereby no image is formed on the sheet 2. On the other hand, at the print portion B, the control electrodes 17 are applied with the voltage Vb of +300 volts. Thus, the toner 8 on the second roller 6 opposed to the control electrodes 17 is electrically attracted by the control electrodes 17 and the backing electrode 13 to propel through the apertures 16, whereby the converged mass of the toner 8 is deposited on the sheet 8 to form an image on the sheet 2.

Figure 3B:
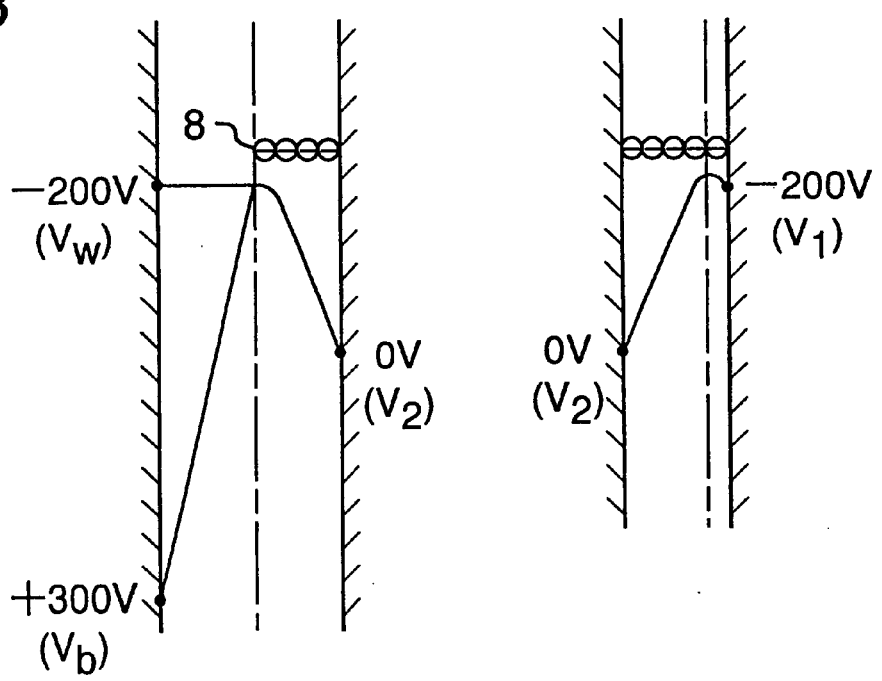
Figure 4A:
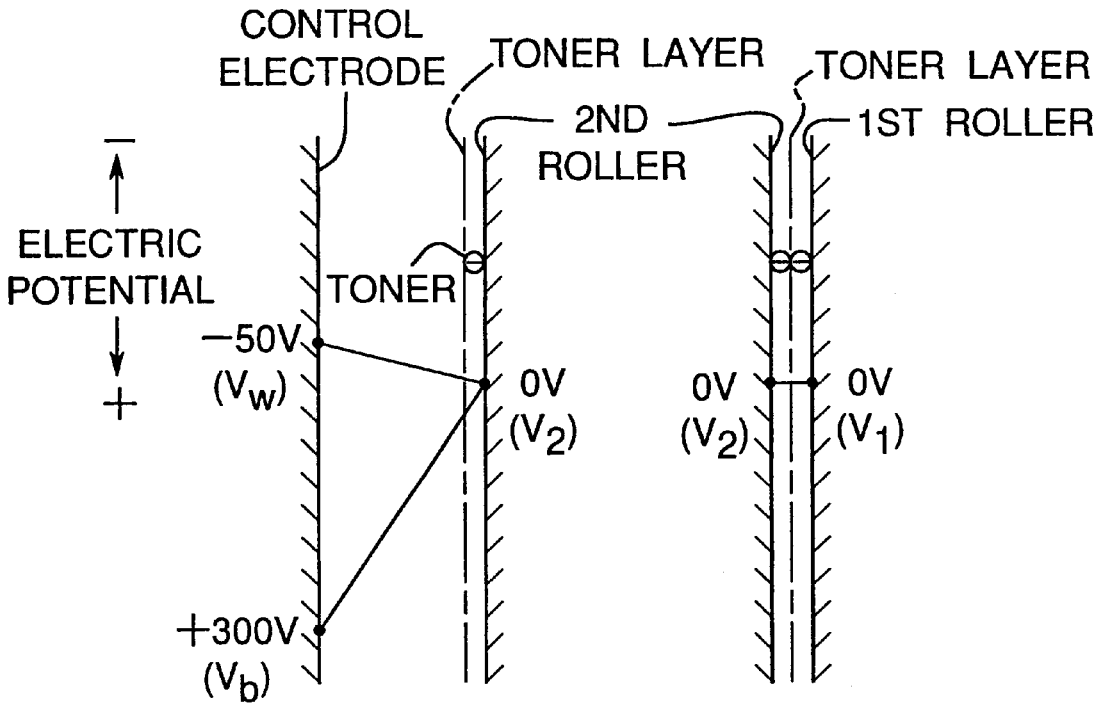
FIG. 4 is a chart showing an electric potential distribution between the first roller, the second roller and the control electrode of the conventional direct printing apparatus in the case that toner charged quantity is small (A) and in the case that toner charged quantity is large (B).
Figure 4B:
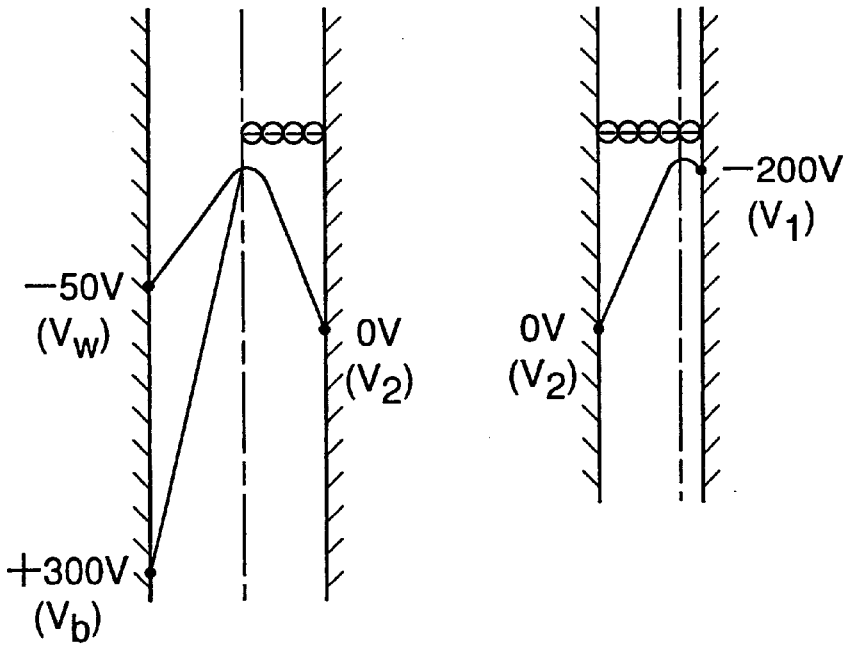

If the toner charged quantity becomes large due to change of condition such as kind or color of the toner 8 to be used, the adhesive strength to the second roller becomes large. Therefore, the toner is difficult to be propelled, thereby desired image density is not obtained. So, as shown in FIG. 3(B), the voltage V1 applied to the developing sleeve 10 of the first roller 5 is changed from zero volt to −200 volts of same polarity as the toner 8. Thereby, quantity of the toner 8 that moves to the second roller 6 from the developing roller 10 of the first roller 5 becomes large so that the toner 8 on the second roller 6 becomes multilayered. Thus, the adhesive strength of the surface layer toner to the second roller 6 becomes small. As a result, the toner 8 on the surface layer of the second roller 6 is easy to be propelled, thereby desired image density is obtained in the print portion B.

However, in the non-print portion W, if the voltage Vw applied to the control electrode 17 remains −50 volts as in the case that the toner charged quantity is small, propelling of the toner 8 cannot be restrained. As a result, a few of the toner on the second roller is propelled, causing fog in the background of the image. So, the voltage Vw applied to the control electrode 17 corresponding to the non-printing portion W is changed from −50 volts to −200 volts. Thus, the electric potential of the control electrode 17 is substantially identical to that of the toner surface layer on the second roller 6, whereby propelling of the toner 8 can be restrained, enabling to eliminate fog in the background of the image.

In the aforementioned embodiment, the voltage Vw applied to the control electrode 17 corresponding to the non-print portion is set to −200 volts. This is because the electric potential of the toner surface layer on the second roller 6 is about −200 volts. If the voltage Vw is set to further minus side, the fog in the background of the image can be perfectly eliminated. The electric potential of the toner surface layer on the second roller 6 is determined by the voltage V1 of the developing sleeve 10 of the first roller 5. Therefore, the voltage Vw applied to the control electrodes 17 may satisfy following relationship.

$$|Vw-V2| \geqq |V1-V2|$$

The maximum value of the voltage Vw applied to the control electrode 17 is an extent that the printing head 15 does not cause breakdown (destroy of insulation), for example, −500 volts. This value can be suitable set in accordance with the voltage applied to the other electrode, distance from the other electrode, and material or shape of the printing head surface.

Although the aforementioned embodiments were explained as to a monochrome type of printing apparatus having a single developing apparatus, the present invention is also applicable to a tandem type of color direct printing apparatus in which a plurality of printing apparatus are disposed in a sheet moving direction.

In the aforementioned embodiments, although the printing apparatus is a type of one component system using only the toner 8, a type of two components system using both toner and carrier may be also applicable.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A direct printing apparatus for directly depositing printing particles on a print medium to print an image, comprising:

a bearing member for bearing printing particles thereon, the printing particles being charged to a predetermined polarity;

a backing electrode opposed to the bearing member; and a printing head disposed between the bearing member and the backing electrode, the printing head having a plurality of apertures through which the printing particles can be propel and a plurality of control electrodes disposed around the plurality of apertures;

wherein the bearing member comprises a first roller and a second roller that comes into contact with the first roller and is opposed to the backing electrode and a voltage V1 is applied to the first roller and a voltage V2 is applied to the second roller; and wherein a voltage having a same polarity as the printing particles borne on the bearing member and having an electric potential more than an electric potential on a surface layer of the printing particles is applied to the control electrodes during a non-printing phase.

2. A direct printing apparatus as claimed in claim 1, wherein the voltage Vw applied to the control electrodes during the non-printing phase meets the following relationship:

$$|Vw-V2| \geqq |V1-V2|.$$

* * * * *